US006321035B1

(12) United States Patent
Gerosa

(10) Patent No.: US 6,321,035 B1
(45) Date of Patent: Nov. 20, 2001

(54) DEVICE FOR INSTANTANEOUSLY PRODUCING STEAM

(75) Inventor: Andrea Gerosa, Pavia (IT)

(73) Assignee: Brasilia SpA, Retorbido (IT)

( * ) Notice: Subject to any disclaimer, the term of this patent is extended or adjusted under 35 U.S.C. 154(b) by 0 days.

(21) Appl. No.: 09/600,953

(22) PCT Filed: Nov. 24, 1999

(86) PCT No.: PCT/EP99/09176

§ 371 Date: Jul. 25, 2000

§ 102(e) Date: Jul. 25, 2000

(87) PCT Pub. No.: WO00/31467

PCT Pub. Date: Jun. 2, 2000

(30) Foreign Application Priority Data

Nov. 25, 1998 (IT) ..... PV980006 U

(51) Int. Cl.[7] ..... F22B 1/28

(52) U.S. Cl. ..... 392/399; 99/330

(58) Field of Search ..... 38/69; 219/271, 219/401; 99/307, 330; 261/72.1; 392/399, 405; 137/15.16; 126/443

(56) References Cited

U.S. PATENT DOCUMENTS

| | | | | |
|---|---|---|---|---|
| 1,995,814 | | 3/1935 | Parker . | |
| 3,721,802 | | 3/1973 | Chrisman . | |
| 3,733,723 | * | 5/1973 | Takakuwa et al. | 38/69 |
| 3,906,188 | | 9/1975 | Gamell . | |
| 4,186,724 | * | 2/1980 | Nelson | 126/657 |
| 4,214,599 | * | 7/1980 | Astrom | 137/15.16 |
| 4,349,723 | * | 9/1982 | Swiatosz | 219/271 |
| 4,697,735 | | 10/1987 | Tample . | |
| 4,835,368 | * | 5/1989 | Fortmann et al. | 219/401 |
| 5,046,409 | * | 9/1991 | Henn | 99/307 |
| 5,371,828 | * | 12/1994 | Ewing | 392/399 |
| 5,680,810 | * | 10/1997 | Sham | 99/330 |
| 5,792,390 | * | 8/1998 | Marino | 261/72.1 |
| 5,949,958 | * | 9/1999 | Naperkowski et al. | 392/399 |
| 6,148,144 | * | 11/2000 | Milanese | 392/405 |

FOREIGN PATENT DOCUMENTS 0 864 827 9/1998 (EP) .

* cited by examiner

*Primary Examiner*—Teresa Walberg
*Assistant Examiner*—L. Fastovsky
(74) *Attorney, Agent, or Firm*—Griffin & Szipl, P.C.

(57) ABSTRACT

Device for instantaneously producing steam comprising a chamber (12) connected to a tank (11) by a duct (13), provided with a pipe (15) containing, as heating member, a halogen lamp (16) and with a nozzle (17) for expelling steam from the chamber (12).

11 Claims, 1 Drawing Sheet

DEVICE FOR INSTANTANEOUSLY PRODUCING STEAM

Figure 1:
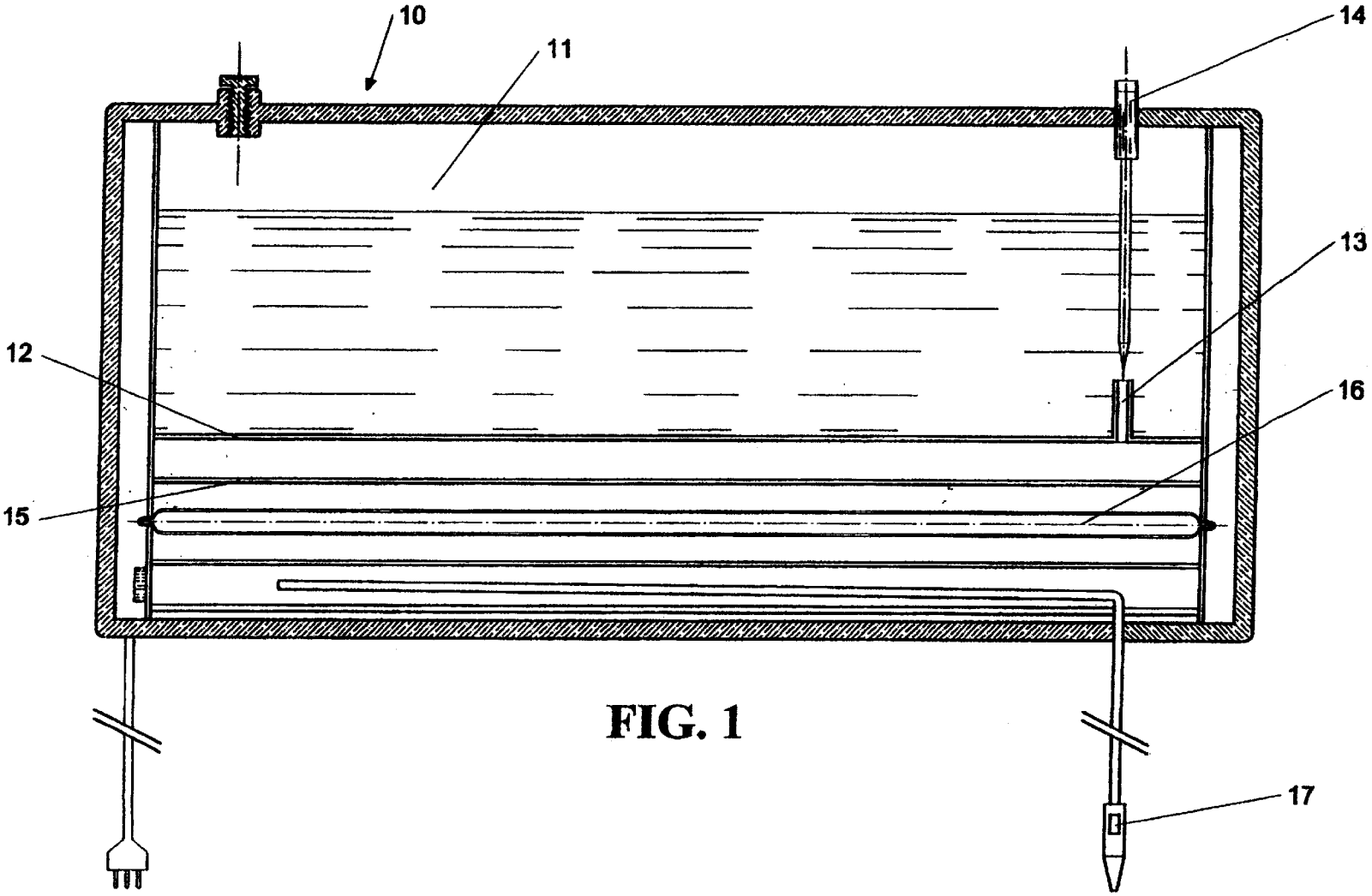

The present invention pertains to a device for instantaneously producing steam.

For obtaining a very good home cleaning are in trade apparatuses producing steam. Such apparatuses comprise a water tank and an electric immersion heater (clad resistor), which when it is turned on, heats the water in the tank and a steam jet comes out from a suitable nozzle and is sprayed on the surface to be cleaned. For heating the immersion heater and the water pool to be transformed in steam, it needs some time and a waste of electric power. All that affects heavily the managing costs of such apparatuses.

Another drawback of such apparatuses is to be compelled to transform all the water contained in the tank in steam and not always the whole produced steam is completely used, so, when it is cooled returns in water. The power consumption for heating and transforming in steam large water quantities is very outstanding.

A further drawback is given by the maintenance of said apparatuses: in fact when the immersion electric heater or clad resistor breaks down or is burned, for its replacement it needs to bring the apparatus to a service centre and such an apparatus is unavailable to the use for some time and the cost of the spare part (the clad resistor) is to be added to the cost of servicing personnel.

Also in steam irons it needs some relatively long time for heating the water therein contained in order to obtain steam.

It is an object of the present invention to obviate the above mentioned drawbacks.

The technical problem to be faced is to provide a device allowing to instantaneously transform water in steam, making it available, and meter the water quantity to be used.

The approach for this technical problem is characterized in that the apparatus comprises a tank containing water, a chamber connected to said tank by means of a duct, a pipe arranged inside the chamber, being provided first means into said pipe for heating said pipe and instantaneously vaporizing the water present in said chamber, and second means to meter the water flow from said tank to said chamber.

Further features and advantages will appear more clearly from the following description and the enclosed drawing, in which: the Figure is a cross section view of the device according to the present invention.

Referring to the FIGURE, it has been generally indicated by 10 a device, for instantaneously producing steam, comprising a tank 11, a cylindrical chamber 12 connected to the tank 11 by a duct 13 which can be closed by a screw plug 14, as it will later explained.

Coaxial and internally to the chamber 12 is provided a pipe 15 enclosing an halogen lamp 16. The pipe 15 is made of steel or some other material suitable to transmit heat.

Preferably, the pipe 15 is made of stainless steel, having an internal surface, faced to the lamp 16, duly roughened for example by sandblasting, to enhance the absorption of the irradiated heat.

Alternatively, the pipe 15 is made of copper, having an internal surface, faced to the lamp 16, duly blackened by either anodic oxidation or super fast cathodic deposition of copper, always to enhance the absorption of the irradiated heat.

It is well known that an halogen lamp, when it is lit, reaches substantially instantaneously a high temperature.

For producing instantaneously steam and make it immediately available for use, the operator fills the tank 11 with water and, by unscrewing the screw plug 14, make flowing it through the duct 13 in the chamber 12. Then he turns on the halogen lamp 16 transmitting immediately the produced heat to the pipe 15 which, in turn, transmits heat to the water contained in the chamber 12, transforming it into steam. The steam, instantaneously produced by turning on the halogen lamp 16, is expelled through a nozzle 17.

If it needs a small quantity of steam, the operator after having made flow the water from the tank 11 to the chamber 12, screws down the plug 14 to close the duct 13. In such a way is transformed into steam just the water quantity enclosed in the chamber 12 and not the whole water contained in the tank; so the power consumption is very restricted.

It is also to realize that the useful life of an halogen lamp 16 housed in such a pipe 15, immersed in a water pool, can be reasonably expected to be longer than the expected life of such a kind of lamp housed in a luminary, because in a luminary the lamp is faced against some transmitting and/or reflecting assemblies which, being immersed in air, many times reach a balance temperature well higher than 100° C., so shortening the useful life of the lamp, while in the present case, as the temperature of the generated steam is just a little higher than 100° C. the balance temperature of lamp 16 and tube 15 assembly remains within the range of 100° C., a longer useful life of the lamp is expected.

In case of break of the lamp 16, its replacement is very simple, corresponding to the replacement of a lamp in a luminary, not requiring any skilled personnel for the replacement, with spare of maintaining cost and time, because the work is made at home without bringing the apparatus to a servicing centre.

What is claimed is:

1. A device for instantaneously producing steam comprising:

a tank containing some water;

a chamber connected to said tank by means of a duct;

a pipe disposed inside said chamber, wherein the inside of said pipe is free of water;

first means disposed inside said pipe for substantially instantaneously heating said pipe and substantially instantaneously vaporizing the water present in said chamber; and second means for metering the water flow from said tank to said chamber.

2. A steam producing device according to claim 1, wherein said first means comprises a halogen lamp which, when lit, substantially instantaneously heats said pipe and substantially instantaneously vaporizing the water present in said chamber.

3. A steam producing device according to claim 1, wherein said second means comprises a screw plug operably mounted onto said duct connecting said tank to said chamber.

4. A steam producing device according to claim 1, wherein said pipe is coaxial with respect to said chamber, and wherein said pipe is made of material suitable to transmit heat.

5. A steam producing device according to claim 4, wherein said pipe is made of stainless steel having a roughened internal surface.

6. A steam producing device according to claim 4, wherein said pipe is made of copper having a blackened internal surface.

7. A steam producing device according to claim 2, wherein said pipe is coaxial with respect to said chamber, and wherein said pipe is made of material suitable to transmit heat.

8. A steam producing device according to claim 7, wherein said pipe is made of stainless steel having a roughened internal surface.

9. A steam producing device according to claim 7, wherein said pipe is made of copper having blackened internal surface.

10. A steam producing device according to claim 2, further comprising a nozzle connected to said chamber to expel steam produced in said chamber.

11. A steam producing device according to claim 1, further comprising a nozzle connected to said chamber to expel steam produced in said chamber.

* * * * *